United States Patent [19]

Talbert

[11] 4,331,362

[45] May 25, 1982

[54] PORTABLE CUTTING DEVICE FOR ATTACHMENT TO BLADES OF EARTH MOVING MACHINES

[76] Inventor: Carroll G. Talbert, 6930 W. Hazelwood, Phoenix, Ariz. 85033

[21] Appl. No.: 178,399

[22] Filed: Aug. 15, 1980

[51] Int. Cl.[3] ..... E01C 23/09

[52] U.S. Cl. ..... 299/37; 299/40; 172/604; 172/778

[58] Field of Search ..... 299/37, 40, 86, 39; 172/777, 778, 604, 21; 404/90, 91

[56] References Cited

U.S. PATENT DOCUMENTS

| | | | |
|---|---|---|---|
| 3,173,493 | 3/1965 | Renault | 172/777 X |
| 3,271,079 | 9/1966 | Simmons | 299/40 |
| 3,472,554 | 10/1969 | Hopkins | 299/40 |
| 3,743,358 | 7/1973 | Guest | 299/40 |
| 4,076,314 | 2/1978 | Dodich | 299/40 |

*Primary Examiner*—Ernest R. Purser
*Attorney, Agent, or Firm*—Cahill, Sutton & Thomas

[57] ABSTRACT

A portable pavement cutting device removably attachable to a blade of an earth moving machine includes a cutting disc having a plurality of sawtooth-like cutting teeth disposed around the entire periphery of the cutting disc for cutting into asphalt pavement. The edges of the cutting teeth adjoin to form a continuous cutting edge around the entire periphery of the cutting disc. The cutting disc is freely rotatably supported between a pair of bifurcated fork arms extending downward from a common base. A V-shaped attachment bracket is attached to the base for receiving the cutting edge of the earth mover blade. Clamping bolts are utilized to clamp the attachment bracket element to the cutting edge of the earth mover blade. A "jack-hammer" mechanism is attached to and supported by the base. A high pressure air source activates the jack-hammer mechanism, which causes the cutting teeth to dig into the asphalt pavement, cutting it as the earth moving machine slowly rolls along the asphalt pavement.

6 Claims, 8 Drawing Figures

PORTABLE CUTTING DEVICE FOR ATTACHMENT TO BLADES OF EARTH MOVING MACHINES

BACKGROUND OF THE INVENTION

1. Field of the Invention

The invention relates to pavement cutting equipment, and more particularly, to relatively small, portable pavement cutting devices which can be removably attached to a blade of an earth moving machine.

2. Description of the Prior Art

There are numerous occasions on which it is desirable to have available an inexpensive, portable pavement cutting device. For example, employees of public utilities, road construction workers, and general contractors, frequently need to cut through asphalt pavement for various reasons. Frequently, workers utilize ordinary hand-held "jack-hammers" having pointed cutting tips. This procedure for cutting pavement is unduly slow, and laborious, especially when the pavement is cold (since asphalt pavement become excessively hard and brittle when it is very cold). A number of pavement cutting devices are known. Some of the known pavement cutting devices utilize rotary cutting wheels which function as high speed rotary saw blades, cutting through the pavement. A device of this type is disclosed in U.S. Pat. No. 2,701,134. The machine disclosed in this reference is unduly expensive, and could not be conveniently used for each of the many pavement cutting tasks frequently required of a contractor or public utility. Furthermore, sawing operations on asphalt pavement result in excessive wear on saw blades, and the cutting achieved is unduly slow. Other types of pavement cutting wheel attachments having circular cutting discs with smooth peripheral cutting edges have been proposed, such as those disclosed in U.S. Pat. Nos. 3,472,554, 3,743,358, and 3,515,435. Another device having a smooth, continuous cutting edge is disclosed in U.S. Pat. No. 3,355,214 and yet another is disclosed in U.S. Pat. No. 4,076,314. While the devices disclosed in the immediately foregoing patents are capable of satisfactorily cutting through warm asphalt pavement at a satisfactorily high rate, they are incapable of doing so if the asphalt is cold. U.S. Pat. No. 3,271,079 discloses a complex pavement cutting machine which includes a smooth blade cutting disc and a large, bulky mechanism powered by a gasoline engine for imparting a high frequency up-and-down and forward-and-backward vibratory motion to an arm supporting the cutting wheel. However, the small (⅛ inch) displacement of the vibratory motion, while tending to slightly improve the cutting action of the cutting wheel, is totally inadequate to enable the cutting wheel to efficiently penetrate and divide cold asphalt pavement. There is clearly an unmet need for a small, portable, inexpensive, efficient pavement cutting machine capable of efficiently cutting through cold asphalt pavement.

Accordingly, it is an object of the invention to provide a low cost, portable pavement cutting device which is removably attachable to a cutting blade of an earth moving machine.

It is another object of the invention to provide a pavement cutting machine wherein a freely rotatable cutting disc is enabled to penetrate cold asphalt in response to a particular average downward force imparted to the cutting wheel more rapidly and more efficiently than any pavement cutting wheel known in the prior art.

Still another object of the present invention is to provide a pavement cutting device which overcomes the above mentioned shortcomings of the prior art.

SUMMARY OF THE INVENTION

Briefly described, and in accordance with one embodiment thereof, the invention provides a pavement cutting device which is removably attachable to the blade of an earth moving machine, the pavement cutting device including a cutting disc having a plurality of sawtooth-like cutting teeth disposed about the periphery of the cutting wheel, forming a continuous jagged cutting edge. The depth of each cutting tooth is sufficiently great to penetrate substantially through one slab of asphalt pavement being cut. A cutting disc is supported by a pair of bifurcated fork arms supporting and extending upward from an axle, by means of which the cutting wheel freely rotates. A V-shaped mounting bracket has a force receiving surface along the bottom of the V-shape to receive downward thrust of an edge of the blade of the earth moving machine. Clamping means are connected to the mounting bracket for clamping the V-shaped mounting bracket to the earth mover blade. A stud rigidly mounted to and extending upwardly from the top of a base from which the fork arms extend is rigidly attached to the base for receiving the chuck of a "jack-hammer" mechanism. In the described embodiment of the invention, the jack-hammer mechanism is connected by means of a high pressure air hose to an air compressor mounted on the earth moving machine. The high air pressure thereby supplied to the jack-hammer mechanism actuates a heavy, oscillating piston within the jack-hammer mechanism, which piston repeatedly strikes the top of the stud-receiving chuck at a high frequency, causing the cutting teeth to be repetively incrementally driven into the asphalt pavement to be cut. The repetitive impact of the jack-hammer mechanism, superimposed on a downward force produced by an operator of the earth moving machine on the blade thereof, causes the cutting teeth to rapidly penetrate even cold asphalt, so that the earth moving machine can be steadily moved forward at a rate much higher than any rate which would be possible for any prior pavement cutting device.

DESCRIPTION OF THE INVENTION

Figure 1:
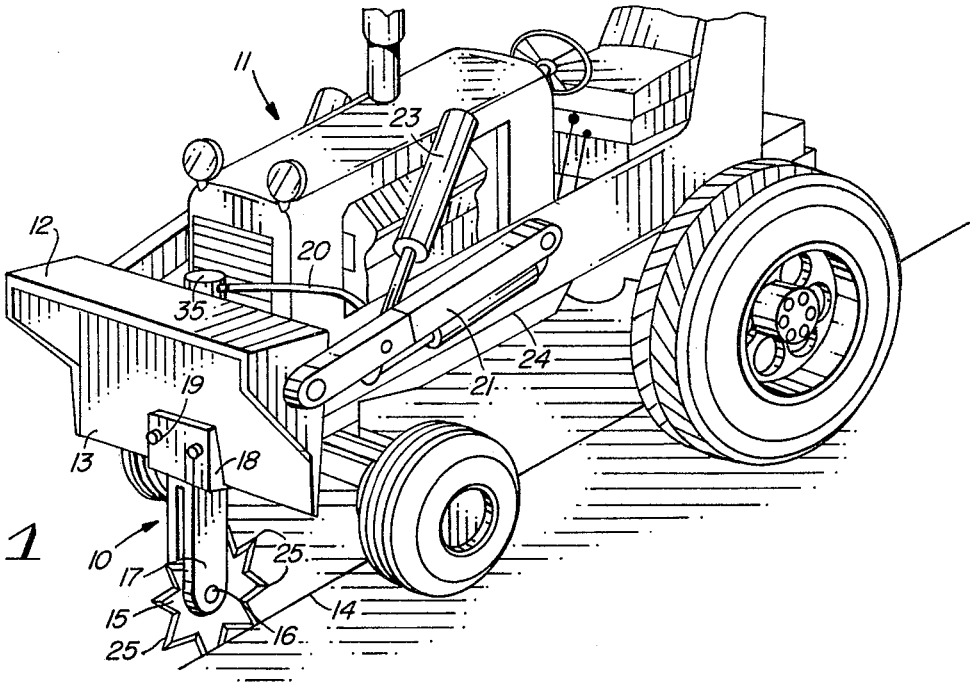
FIG. 1 is a perspective view illustrating the pavement cutting mechanism of the invention attached to a tractor having a front end loader.

Referring now to the drawings, particularly FIGS. 1–4, pavement cutting device 10 is clamped onto the blade edge 13 of a loader bucket 12. Loader bucket 12 is connected by means of arms 21 to a tractor 11. Pneumatic cyclinder 23, in response to a control lever (not shown) actuated by the driver of the tractor, raises or lowers the forward end of arms 21, thereby raising pavement cutter 10 above the asphalt pavement on which tractor 11 rests, or forcing pavement cutting device 10 downward against and into asphalt pavement to be cut, as subsequently explained. Pneumatic cylinder 24, in response to another control lever actuated by the driver, controls the angle which the shovel 12 makes with respect to arms 21.

Pavement cutting device 10 includes a rotatable cutting disc which is freely rotatably supported by means of an axle 16 and bearings 16A.

Fork members 17A and 17B extend downwardly from an elongated rectangular block 17, which has a hexagonal stud 33 extending from the upper surface thereof.

A V-shaped mounting bracket 18 includes a rear plate 18B and a front plate 18A disposed at an angle with respect to rear plate 18B to enable blade 13 to fit between plates 18A and 18B.

Figure 2:
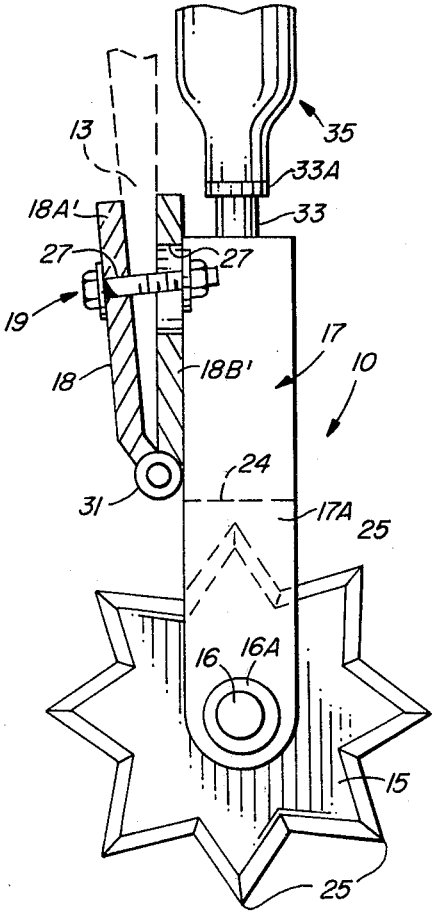
FIG. 2 is a partial side view of the pavement cutter shown in FIG. 1.
Figure 3:
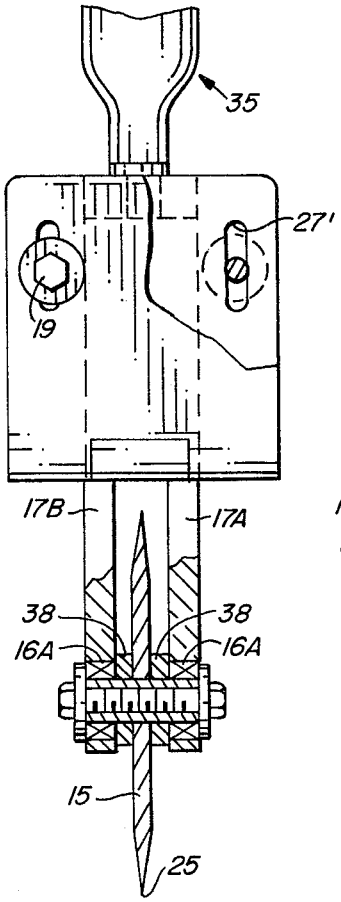
FIG. 3 is a partial cutaway front view of the pavement cutter shown in FIG. 2.

In accordance with one important aspect of the invention, cutting disc 15 includes a plurality (roughly ten) of sawtooth-like cutting teeth 25, the inclined edges of which form a continuous cutting edge around the periphery of cutting disc 15. The diameter of cutting disc 15 can be approximately twelve inches, and the length of each of cutting teeth 25 can be approximately two inches. The distance between the lowest point of cutting disc 15 and the lowest point of fork 17A is approximately four inches. As can be seen in FIGS. 2 and 3, each cutting tooth includes a sharp point and two cutting edges which join at the sharp point. Each cutting edge joins a cutting edge of an adjacent cutting tooth, so that a continuous cutting edge surrounds the periphery of cutting disc 15.

In accordance with another important aspect of the invention, a "jack-hammer-like" device having a chuck 36 at its lower end for receiving the upper end of stud 33 is supported by stud 33. Jack-hammer mechanism 35 is connected by means of a high pressure air hose 20 (FIG. 1) to a compressor in the engine compartment of tractor 11. The air pressure can be controlled by a control lever (not shown) actuatable by the driver. The weight of satisfactory commercially available jack-hammer mechanisms is approximately 90 pounds.

Figure 4:
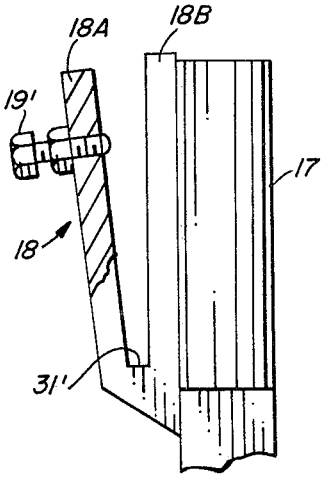
FIG. 4 is a partial cutaway side view of the attachment clamp utilized to attach the pavement cutter to the earth moving blade in FIG. 1.

FIG. 4 shows a partial cutaway side view of one embodiment of V-shaped blade-receiving mounting bracket 18. Blades 18A and 18B are rigidly welded together. Blade 18B is welded against block or base 18. A force receiving surface 31' along the bottom of V-shaped attachment bracket 18 receives most of the downward force from the leading edge of blade 13. A bolt 19' extends through a threaded hole in plate 18A, so that the leading end of the bolt 19' can be tightened against blade 13, thereby attaching pavement cutter 10 to blade 23.

In an alternate embodiment of the V-shaped attachment bracket, shown in FIG. 2, a hinged attachment bracket 18' includes plate 18B welded to block 17 and plate 18A' hingably attached by means of hinge 31 to the lower end of plate 18B'. For this embodiment of the invention, it is necessary that holes for bolts 18 be drilled through blade 13 of shovel 12. A somewhat elongated slot 27' (FIG. 3) is provided in plate 18B' to receive the shaft of bolt 19 at different angles which may result for cutting blades 13 having different thicknesses or angles.

Figure 5A:
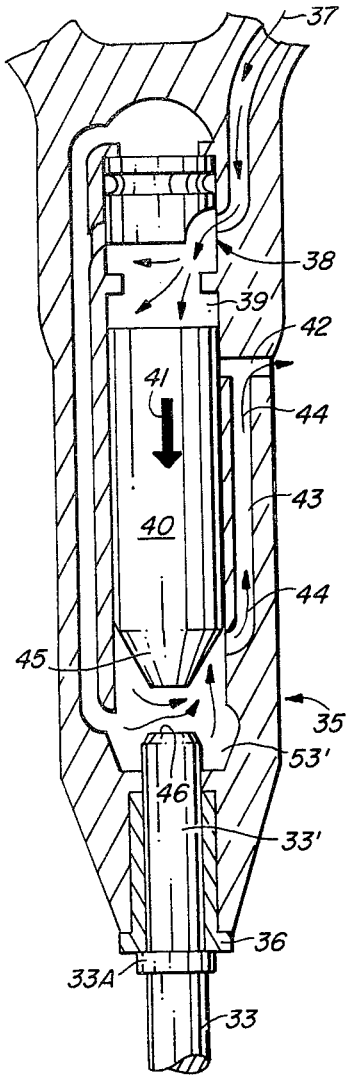
FIGS. 5A–5C are sectional views useful in describing the structure and operation of the jack-hammer mechanism of the pavement cutting device of FIG. 1.
Figure 5B:
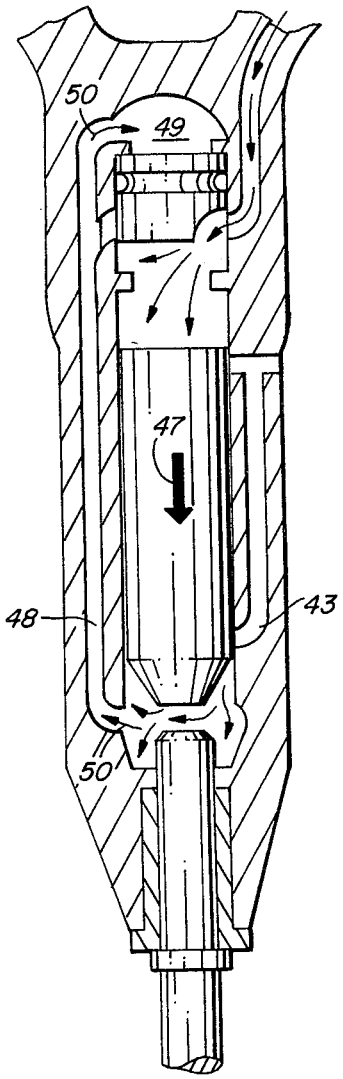
Figure 5C:
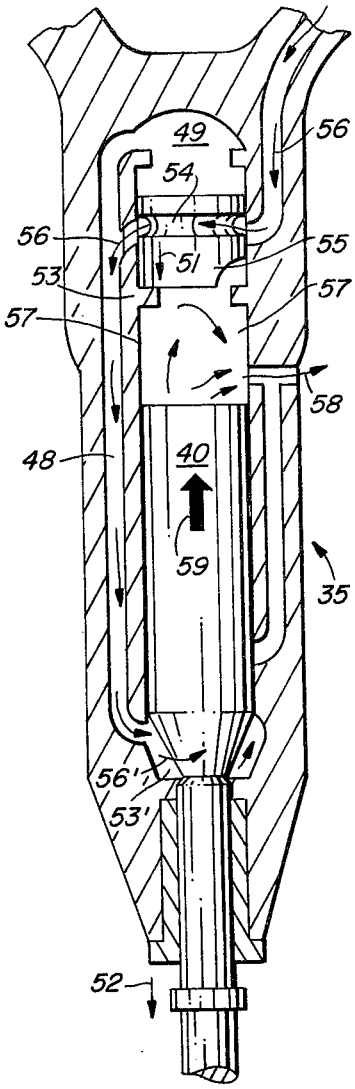

FIGS. 5A–5C illustrate one type of jack-hammer mechanism which can be utilized. Such jack-hammer devices are well known and are commercially available. However, the principle of operation is briefly set forth herein to provide a better understanding of the working of pavement cutter 10. Referring now to FIG. 5A, compressed air from hose 20 enters air passage 37, and flows into region 39, as indicated by arrows 38. This causes a heavy slidable piston 40 to move downward in the direction indicated by arrow 41, so that hammer end 45 ultimately strikes an upper "anvil" surface 46 of stud 33. Note that stud 33 has a rigid collar 33A thereon for receiving the lower end of chuck 36, limiting the extension of stud 33 into chuck 36 and supporting the width of jack-hammer mechanism 35 on stud 33. As piston 40 travels downward, air in region 53 is exhausted, as indicated by arrows 44, through passage 43 and outlet 42. As piston 40 continues downward, its lower end blocks off passage 43, forcing air in region 53 to flow through passage 48 into region 49 at the upper end of jack-hammer mechanism 35, as indicated in FIG. 5B. This causes piston valve 51 to move downward in the direction indicated by arrow 51 as pressure builds up in region 49. Piston 40 then strikes anvil surface 46, providing a very sharp impact which drives one or two of cutting teeth 25 (FIG. 2) into the asphalt pavement, even if the asphalt pavement is cold. As pressure continues to build up in chamber 49, piston valve 51 slides downward in direction indicated by arrow 51, causing incoming air from hose 20 to pass along groove 54 of piston valve 55, into an opening in cylinder wall 57 and into passage 48, as indicated by arrows 52 and 56. This air enters chamber 53', as indicated by arrow 56', forcing piston 40 back up to its initial position, as indicated by arrow 59. As this occurs, air in region 57 is exhausted through an opening in the side of jack-hammer mechanism 55, as indicated by arrow 58. As the foregoing cycle is repeated, piston 40 oscillates up and down at a high frequency, repeated by incrementally hammering the lowest cutting teeth 25 into the asphalt pavement.

Figure 6:
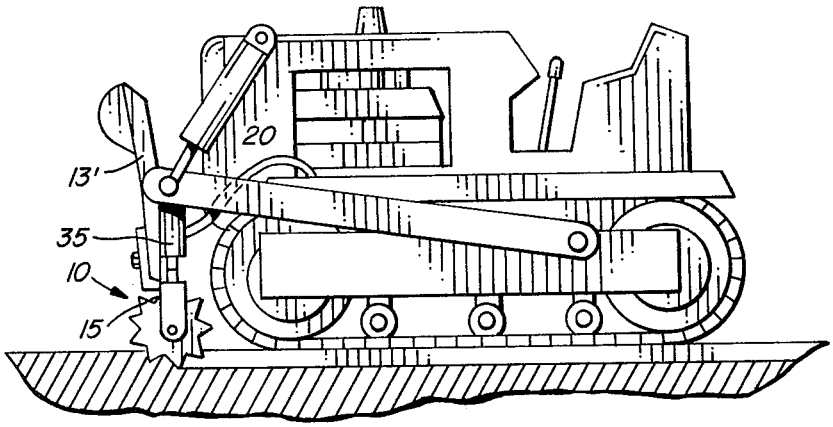
FIG. 6 is a side view illustrating use of the pavement cutting device of the invention on a different type of earth moving blade.

Referring now to FIG. 6, it can be seen that pavement cutter 10 readily can be attached to the type of blade 13' ordinarily attached to the front end of a crawler.

In operation, the above-described pavement cutter is utilized by actuating the hydraulic blade system of the tractor or crawler to raise the blade thereof, locating the pavement cutter at the beginning of the line which is desired to be cut in the asphalt pavement, and then lowering the blade so that a suitable downward pressure is exerted on the pavement by teeth 25 of cutting disc 15. Highly compressed air is then forced into the inlet of jack-hammer mechanism 35, which causes the cutting teeth 25 to readily sink (by repeatedly being hammered by piston 40) into asphalt pavement, even if the asphalt pavement is cold. The operator then slowly moves the tractor or crawler forward, maintaining the downward pressure or cutting disc 10 by applying downward pressure on the blade 13 and continuing the inflow of high pressure compressed air to the jack-hammer mechanism 35. Cutting disc 15 thereby slowly rotates, the repetitive downward penetration of additional cutting teeth 25 into the asphalt pavement as cutting disc 15 rotates forward, cutting a line in the asphalt pavement.

While the invention has been described with reference to a particular embodiment thereof, those skilled in the art will be able to make variuos modifications to the disclosed embodiments of the invention without departing from the true spirit and scope thereof. For example, bracket 18 can be non-rigidly connected to block 17 so as to allow vertical movement of block 17 relative to bracket 18, whereby the tendency of the mass of blade 12 to dampen effect of the downward impact produced by jack-hammer mechanism 35 is avoided. Alternatively, if bracket 18 is bolted to blade tip 13 by means of bolts extending through blade tip 13, as shown in FIG. 2, the same result can be achieved by providing elongated slots for bolt 19' in blade tip 13.

I claim:

1. A pavement cutting device for making cuts in asphalt pavement, said pavement cutting device comprising in combination:

(a) a cutting disc, said cutting disc having a plurality of cutting teeth disposed uniformly along the periphery of said cutting disc, each of said cutting teeth having a sharp point and two cutting edges which join at said sharp point, said cutting edges of each of said cutting teeth each adjoining said cutting edge of an adjacent one of said cutting teeth;

(b) first and second fork members for rotatably supporting said cutting disc;

(c) axle means extending through said cutting disc for engaging lower end portions of said first and second fork members for supporting of said cutting disc and allowing free rotation of said cutting disc;

(d) connecting means attached to upper ends of said first and second fork member means for removably connecting said pavement cutting device to an earth moving blade of an earth moving machine;

(e) impact means supported by said first and second fork members for repetitively producing downward impact on said cutting disc to pound said cutting teeth into said asphalt pavement, thereby enhancing the penetration of said cutting teeth into said asphalt pavement, increasing the rate at which said earth moving machines can move along said asphalt pavement while said pavement cutting device cuts said asphalt pavement, wherein said impact means includes a jack-hammer means, said pavement cutting device including a block from which said first and second fork members extend, a stud extending rigidly upward from said block, said jack-hammer means having a chuck for receiving said stud to support said jack-hammer mechanism on said stud, whereby said cutting disc cuts said asphalt pavement as said earth moving machine moves along said asphalt pavement.

2. The pavement cutting device of claim 1 wherein said cutting disc is approximately twelve inches in diameter and wherein the length of each of said cutting teeth is approximately two inches.

3. The pavement cutting device of claim 1 wherein said connecting means includes a vee-shaped bracket rigidly connected to said block, said vee-shaped bracket receiving a pounded edge of said earth moving blade.

4. The pavement cutting device of claim 3 wherein said connecting means includes means for non-rigidly connecting said block to said earth moving blade to allow downward displacement of said block produced in response to said jack-hammer means relative to said earth moving blade.

5. The pavement cutting device of claim 3 wherein said vee-shaped bracket includes a bolt and said earth moving blade includes a hole through which said bolt extends to connect said vee-shaped bracket to said earth-moving blade.

6. The pavement cutting device of claim 5 wherein said vee-shaped bracket includes a first plate which is hingeably connected to a second plate, said second plate being connected to said block.

* * * * *